US009046102B2

(12) United States Patent
Naganuma et al.

(10) Patent No.: US 9,046,102 B2
(45) Date of Patent: Jun. 2, 2015

(54) GEAR PUMP DEVICE WITH SEAL MECHANISM

(71) Applicants: ADVICS CO., LTD., Kariya-shi (JP); DENSO CORPORATION, Kariya-shi (JP)

(72) Inventors: Takahiro Naganuma, Kariya (JP); Yuki Nakamura, Kariya (JP)

(73) Assignees: ADVICS CO., LTD., Kariya-Shi, Aichi-Ken (JP); DENSO CORPORATION, Kariya-Shi, Aichi-Ken (JP)

( * ) Notice: Subject to any disclaimer, the term of this patent is extended or adjusted under 35 U.S.C. 154(b) by 133 days.

(21) Appl. No.: 13/950,031

(22) Filed: Jul. 24, 2013

(65) Prior Publication Data

US 2014/0030132 A1 Jan. 30, 2014

(30) Foreign Application Priority Data

Jul. 24, 2012 (JP) ..... 2012-163894

(51) Int. Cl.

| | |
|---|---|
| ***F04C 15/00*** | (2006.01) |
| ***F04C 18/08*** | (2006.01) |
| *F04C 2/10* | (2006.01) |
| *F04C 2/18* | (2006.01) |

(52) U.S. Cl.

CPC . *F04C 18/08* (2013.01); *F04C 2/10* (2013.01); *F04C 2/18* (2013.01); *F04C 15/0026* (2013.01)

(58) Field of Classification Search

CPC .. F04C 15/0026; F04C 15/0023; F04C 18/08; F04C 2/10; F04C 2/18

USPC ..... 418/192, 193, 191, 206.6, 131, 132, 418/125, 126, 166, 171, 144, 139; 277/579–582, 358, 390, 377

See application file for complete search history.

(56) References Cited

U.S. PATENT DOCUMENTS

| | | | | |
|---|---|---|---|---|
| 3,363,578 | A * | 1/1968 | Sisson | 418/132 |
| 3,371,615 | A * | 3/1968 | Pettyjohn et al. | 418/132 |
| 3,496,877 | A * | 2/1970 | Jung et al. | 418/126 |
| 3,748,063 | A * | 7/1973 | Putnam | 418/132 |
| 3,890,068 | A * | 6/1975 | Davidson | 418/132 |
| 5,354,188 | A * | 10/1994 | Arbogast et al. | 418/132 |
| 6,273,527 | B1 * | 8/2001 | Yamaguchi et al. | 303/116.4 |
| 6,905,321 | B2 | 6/2005 | Uchiyama et al. | |

(Continued)

FOREIGN PATENT DOCUMENTS

JP 2012-052455 A 3/2012

*Primary Examiner* — Thomas Denion
*Assistant Examiner* — Xiaoting Hu
(74) *Attorney, Agent, or Firm* — Buchanan Ingersoll & Rooney PC

(57) ABSTRACT

A gear pump device of this disclosure includes: a gear pump; a casing; and a seal mechanism, wherein the seal mechanism includes: an annular rubber member; an outer member; and an inner member, which has an outer peripheral wall on which the annular rubber member is mounted, the inner member fitted into an inner side of the outer member and contacting on an inner wall face of the outer shell, wherein the outer peripheral wall of the inner member is provided with a collar portion that generates a propulsive force towards the inner wall face of the outer shell of the casing by a contact pressure of the annular rubber member based on a discharge pressure of the gear pump, and the collar portion forms a pressure receiving face to increase the propulsive force as the contact pressure of the annular rubber member increases according to an increase of the discharge pressure.

3 Claims, 7 Drawing Sheets

(56) References Cited

U.S. PATENT DOCUMENTS

| | | | | |
|---|---|---|---|---|
| 7,124,930 | B2 | 10/2006 | Ariki et al. | |
| 7,247,005 | B2 | 7/2007 | Fuchida et al. | |
| 7,399,171 | B2 | 7/2008 | Yamaguchi et al. | |
| 7,530,647 | B2 | 5/2009 | Yamaguchi et al. | |
| 7,931,454 | B2 | 4/2011 | Yamaguchi et al. | |
| 2003/0031578 | A1* | 2/2003 | Uchiyama et al. | 418/171 |
| 2008/0048492 | A1 | 2/2008 | Sakai | |
| 2009/0232690 | A1* | 9/2009 | Maruo et al. | 418/191 |
| 2010/0060074 | A1* | 3/2010 | Yamaguchi et al. | 303/116.4 |
| 2010/0247362 | A1* | 9/2010 | Koizumi et al. | 418/140 |
| 2011/0116939 | A1 | 5/2011 | Kawabata et al. | |
| 2011/0116949 | A1 | 5/2011 | Kawabata | |
| 2011/0233993 | A1 | 9/2011 | Sakai | |
| 2012/0051959 | A1* | 3/2012 | Nakamura et al. | 418/104 |
| 2012/0051960 | A1 | 3/2012 | Nakamura et al. | |
| 2012/0091664 | A1 | 4/2012 | Okamura et al. | |
| 2012/0242140 | A1* | 9/2012 | Koizumi et al. | 303/10 |
| 2013/0064704 | A1 | 3/2013 | Nakamura et al. | |
| 2013/0075979 | A1 | 3/2013 | Kato et al. | |
| 2013/0101448 | A1 | 4/2013 | Ando et al. | |

* cited by examiner

GEAR PUMP DEVICE WITH SEAL MECHANISM

CROSS-REFERENCE TO RELATED APPLICATION

This application claims priority from Japanese Patent Application No. 2012-163894 filed on Jul. 24, 2012, the entire subject matter of which is incorporated herein by reference.

TECHNICAL FIELD

This disclosure relates to a gear pump device such as a trochoid pump and the like for pumping fluid through enmeshing of gears, which is suitable to be applied to a vehicle brake system, for example.

BACKGROUND

Currently, when a gear pump is unified and then the pump body is secured to a housing (casing) accordingly, since a variation may occur in an axial force in case that the axial force is generated to fill a gap between members by screw-fastening, a leaf spring is placed at a base position or a distal end of the pump body, thereby suppressing the variation in the axial force. However, since an arrangement space of the leaf spring is needed and so on, it is not sufficient for miniaturization of the pump device.

Accordingly, in JP-A-2012-52455, it has been disclosed a structure that discharge chambers are arranged at both outer sides of the pump body in an axial direction and members are pressurized each other by a discharge pressure of the pump itself, thereby preventing the gap from being created between the members, so that the miniaturization thereof may be aimed by the elimination of the leaf spring.

SUMMARY

However, in the structure of JP-A-2012-52455, there is a possibility that a gap occurs between an outer shell of the housing, which defines a discharge chamber at both the outer sides of the pump body in the axial direction, and a ring-shaped seal mechanism, which is disposed at an inner side of the housing outer shell to be pressed in an axial direction relative to the rotor to define a discharge chamber. Specifically, although the design of an axial dimension of each member forming the seal mechanism is made so as to match the distance from the end surface of the rotor in the axial direction to the housing outer shell that defines the discharge chamber, the gap may be generated due to the accumulation of dimensional variations within the scope of the tolerances of each member, or creep or elastic deformation of each of the members when the discharge pressure is applied thereto. If such a gap is formed, a leakage pressure may be generated through the gap, or an elastic seal member (O-ring and the like) included in the seal mechanism disposed adjacent to the housing outer shell may enter the gap to thereby be deformed abnormally, accordingly making it difficult to improve its durability.

With considering the above, the axial direction dimension of the member which is accommodated in the housing outer shell may set large in advance. However, in this case, a drive torque of the rotor increases and a loss torque thereof occurs, so that the rotor is pressed in an axial direction before the discharge pressure is generated.

In view of the above, this disclosure is provide at least a gear pump device which is capable of eliminating the gap between a ring shaped seal mechanism and a housing (casing) outer shell, thereby preventing an elastic seal member from entering the gap and suppressing the generation of a loss torque.

A gear pump device of this disclosure includes: a gear pump, which includes a first gear and a second gear configured to engage with the first gear so that a suction and discharge operation of fluid is performed by the first gear and the second gear being rotated based on a rotation of a shaft; a casing, which configures a receiving portion, in which the first gear and the second gear are accommodated; and a seal mechanism, which is provided between an outer shell of the casing and the gear pump, the seal mechanism defining a low-pressure side including a suction side of the gear pump that suck the fluid and a periphery of the shaft and a high-pressure side including a discharge chamber that discharges the fluid, wherein the seal mechanism includes: an annular rubber member, which surrounds the low-pressure side and seals between the low-pressure side and the discharge side; an outer member, which is arranged at outer side of the annular rubber member to contact on end face of the first gear and the second gear in axial direction; and an inner member, which has an outer peripheral wall on which the annular rubber member is mounted, the inner member fitted into an inner side of the outer member and contacting on a inner wall face of the outer side of the casing at an opposite side of the gear pump, wherein the outer peripheral wall of the inner member is provided with a collar portion that generates a propulsive force towards the inner wall face of the inner member by a contact pressure of the annular rubber members based on a discharge pressure of the gear pump, and the collar portion forms a pressure receiving face to increase the propulsive force as the contact pressure of the annular rubber members increases according to an increase of the discharge pressure.

According to the above configuration, since the pressure-receiving face of the inner member is pushed in a vertical direction of the face thereby causing the inner member to receive a propulsive force in a direction away from the gear pump during the operation of the pump, it is possible to eliminate the gap between them by allowing the inner member to contact on the inner wall face of the outer shell of the casing, which is at an opposite side to the gear pump. Further, the annular rubber member is pressed on the inner wall face of the casing by a discharge pressure of high pressure. Therefore, it is possible to seal the high-pressure side of the outer side and the low-pressure side of the inner side of the annular rubber member by the annular rubber member and the inner member.

According to the above configuration, while the inner member is being contact with the inner wall face of the casing to eliminate the gap between them, the sealing of the high pressure side and low pressure side can be performed accurately. Therefore, it is possible to suppress a leakage pressure that may occur when a gap is formed between them and deterioration in its durability that may occur when the annular rubber member enters the gap to be deformed abnormally. Further, since the annular rubber member serves to increase or decrease the contact pressure on the pressure receiving face of the inner member in accordance with the increase or decrease of the discharge pressure during operation of the gear pump, it is possible to suppress the generation of loss torque. On the other hand, the rubber referred to herein may indicate a relatively soft elastomer, and may include those made of a resin-based material. The "relatively soft" means relatively soft as compared with the gear pump, casing, outer member, or the inner member.

In the above described pump device, the annular rubber member may contact on the outer member. According to the above configuration, the annular rubber member is in contact with the outer member. Thus, when the annular rubber is configured to be in contact with the outer member, it is possible to improve the effect of preventing the discharge pressure from leaking toward the contact portion side of the outer member and the inner member through between the outer member and the annular rubber member.

In the above described pump device, the collar portion is a flange portion formed on the outer peripheral wall of the inner member, and the face of the annular rubber member side of the flange portion is a tapered face.

According to the above configuration, since the pressure-receiving face is formed as the tapered face, the discharge pressure applying in the direction perpendicular to the tapered face during the high-pressure discharge can be converted efficiently into the propulsive force that causes the inner member to be moved to the opposite side of the gear pump. Accordingly, it is possible to more reliably eliminate the gap between the inner wall face of the outer shell of the casing and the inner member, so that the above effect is achieved.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Figure 1:
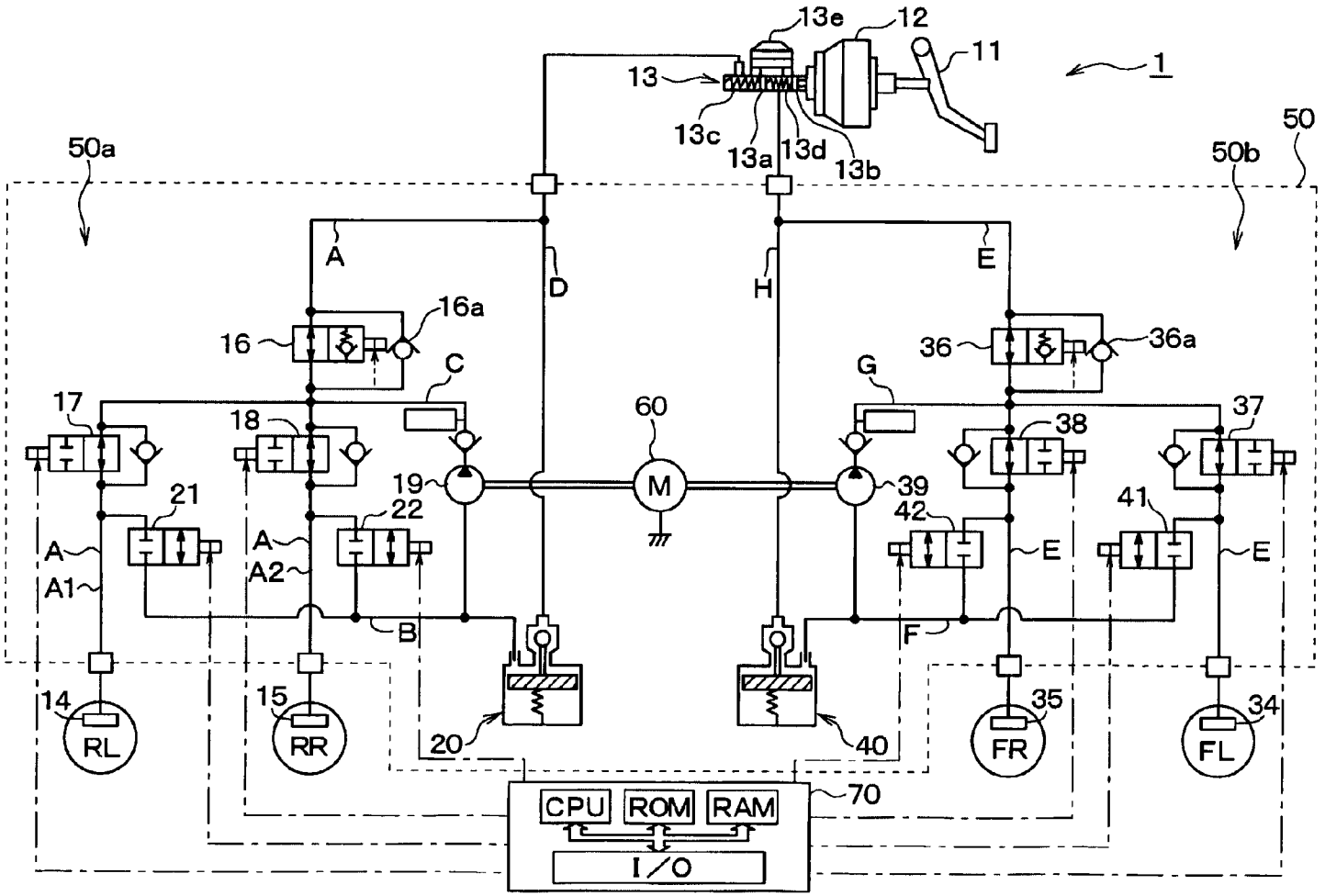
FIG. 1 is a brake piping schematic diagram of a vehicle brake system to which a gear pump device according to a first embodiment of this disclosure is applied.

Hereinafter, exemplary embodiments of this disclosure will now be described with reference to the accompanying drawings. In each of the following embodiments, same portions or equivalents to each other will be described with the same reference numerals.

First Embodiment

Hereinafter, this disclosure will be described according to the embodiments shown in the drawings. FIG. 1 shows the brake piping schematic diagram of a vehicle brake system to which a gear pump device according to one embodiment of this disclosure is applied. Hereinafter, the basic configuration of the vehicle brake system will be described based on FIG. 1. Here, an example, in which the vehicle brake system according to this disclosure is applied to a vehicle having a hydraulic circuit of the front and rear piping, will be described.

As shown in FIG. 1, when a driver depresses a brake pedal 11, which is as a brake operating member, the depression force is boosted by a servo unit 12 and pushes master pistons 13*a* and 13*b* that are disposed in a master cylinder (hereinafter referred to as an M/C) 13. As a result, a same M/C pressure is generated in a primary chamber 13*c* and a secondary chamber 13*d* that are demarcated by the master pistons 13*a* and 13*b*. The M/C pressure is transmitted to respective wheel cylinders (hereinafter referred to as W/Cs) 14, 15, 34, and 35 via a brake fluid pressure control actuator 50. The M/C 13 is provided with a master reservoir 13*e* having passages that communicatively connect with, the primary chamber 13*e* and the secondary chamber 13*d*, respectively.

The brake fluid pressure control actuator 50 is provided with a first piping system 50*a* and a second piping system 50*b*. The first piping system 50*a* is a rear system that controls the brake fluid pressure applied to a left rear wheel RL and a right rear wheel RR, and the second piping system 50*b* is a front system that controls the brake fluid pressure applied to a right front wheel FR and a left front wheel FL.

In comparing of the first piping system 50*a* and the second piping system 50*b*, the first piping system 50*a* is lower in the consumption amount (caliper capacity) of liquid than the second piping system 50*b*. However, since the first piping system 50*a* and the second piping system 50*b* have a similar structure, hereinafter, the first piping system 50*a* will be explained and an explanation of the second piping system 50*b* will be omitted.

The first piping system 50*a* is provided with a conduit A which transmits the above-described M/C pressure to the W/C 14 provided in the left rear wheel RL and to the W/C 15 provided in the right rear wheel RR, and which serves as a main conduit that generates a W/C pressure.

Further, the conduit A is provided with a first differential pressure control valve 16 to be controlled between a communicated state and a differential pressure state. A valve position of the first differential pressure control valve 16 is adjusted such that the first differential pressure control valve 16 is in the communicated state during normal braking (when vehicle motion control is not being performed) when the driver performs an operation of the brake pedal 11. When a current is applied to a solenoid coil provided in the first differential pressure control valve 16, the valve position is adjusted such that, the larger the value of the current is, the larger the differential pressure is.

When the first differential pressure control valve 16 is in the differential pressure state, the brake fluid is allowed to flow from the side of the W/Cs 14 and 15 to the side of the M/C 13 only when the brake fluid pressure in the side of the W/Cs 14 and 15 is higher than the M/C pressure by a predetermined pressure or more. Therefore, the brake fluid pressure in the side of the W/Cs 14 and 15 is constantly maintained not to be higher than the pressure on a side of the M/C 13 by the predetermined pressure or more.

The conduit A branches into two conduits A1 and A2 in the side of the W/Cs 14 and 15, which is downstream lower than the first differential pressure control valve 16. A first pressure increasing control valve 17, which controls a pressure increase in the brake fluid pressure to the W/C 14, is provided in the conduit A1. A second pressure increasing control valve 18, which controls a pressure increase in the brake fluid pressure to the W/C 15, is provided in the conduit A2.

The first and the second pressure increasing control valves 17 and 18 are each formed by a two-position electromagnetic valve that is to be controlled between a communicated state and a closed state. More specifically, the first and the second pressure increasing control valves 17 and 18 are normally open type valves, where valves are brought into the communicated state when a control current applied to solenoid coils provided in the first and the second pressure increasing control valves 17 and 18 is zero (i.e. when no current is applied) and valves are controlled to the closed state when the control current is allowed to flow to the solenoid coils (i.e., when applying current).

A conduit B, serving as a pressure reducing conduit, connects a portion of the conduit A between the first and second pressure increasing control valves 17 and 18 and the W/Cs 14 and 15 with a pressure adjusting reservoir 20. The conduit B is provided with a first pressure reducing control valve 21 and a second pressure reducing control valve 22 that are each formed by a two-position electromagnetic valve that is to be controlled between a communicated state and a closed state. The first and the second pressure reducing control valves 21 and 22 are normally closed valves.

A conduit C, serving as a reflux conduit, is provided between the pressure adjusting reservoir 20 and the conduit A that is the main conduit. The conduit C is provided with a self-priming gear pump 19 that is driven by a motor 60 and that sucks the brake fluid from the pressure adjusting reservoir 20 and discharges it to the side of the M/C 13 or to the side of the W/Cs 14 and 15. The motor 60 is driven by controlling current to a motor relay, which is not shown.

Further, a conduit D, serving as an auxiliary conduit, is provided between the pressure adjusting reservoir 20 and the M/C 13. The brake fluid is sucked by the gear pump 19 from the M/C 13 through the conduit D and discharged to the conduit A. As a result, the brake fluid is supplied to the side of the W/Cs 14 and 15 during vehicle motion control, and the W/C pressure of a target wheel is increased.

Meanwhile, although the first piping system 50*a* is described, the second piping system 50*b* also has a similar structure, and the second piping system 50*b* is also provided with structural elements that are similar to those provided in the first piping system 50*a*. Specifically, the second piping system 50*b* is provided with a second differential pressure control valve 36 that corresponds to the first differential pressure control valve 16, third and fourth pressure increasing control valves 37 and 38 that correspond to the first and the second pressure increasing control valves 17 and 18, third and fourth pressure reducing control valves 41 and 42 that correspond to the first and the second pressure reducing control valves 21 and 22, a pump 39 that corresponds to the pump 19, a reservoir 40 that corresponds to the reservoir 20, and conduits E to H that correspond to the conduits A to D. However, for W/Cs 14 and 15, 34, and 35 to which each of the systems 50*a* and 50*b* supplies a brake fluid, the capacity of the second piping system 50*b* as a front system is larger than the capacity of the first piping system 50*a* as a rear system. Thus, it is possible to generate a greater braking force than the front side.

Further, a brake ECU 70 corresponds to a vehicle motion control device of this disclosure that controls a control system of a brake control system 1, and is formed with a known microcomputer that is provided with a CPU, a ROM, a RAM, an I/O port and the like. The brake ECU 70 performs processing, such as various types of calculation, according to programs stored in the ROM and the like, thus performing vehicle motion control such as antiskid control etc. More specifically, the brake ECU 70 calculates various types of physical quantities based on detection by sensors that are not shown in the drawings, and based on the calculation results, the brake ECU 70 determines whether or not to perform vehicle motion control. When the vehicle motion control is performed, the brake ECU 70 calculates a control amount for a control target wheel, namely, a W/C pressure to be generated at the W/C of the control target wheel. Based on a result of the calculation, the brake ECU 70 controls the supply of current to each of the control valves 16 to 18, 21, 22, 36 to 38, 41 and 42, and also controls the amount of current supplied to the motor 60 to drive the pumps 19 and 39. Thus, the W/C pressure of the control target wheel is controlled and the vehicle motion control is performed.

When no pressure is generated at the M/C 13 as in traction control or antiskid control, for example, the pumps 19 and 39 are driven, and at the same time, the first and the second differential pressure valves 16 and 36 are brought into a differential pressure state. Thus, the brake fluid is supplied through the conduits D, H to the downstream side of the first and the second differential pressure control valves 16 and 36, namely, to the side of the W/Cs 14, 15, 34, and 35. Then, increase/decrease of the W/C pressure of the control target wheel is controlled by appropriately controlling the first to the fourth pressure increasing control valves 17, 18, 37 and 38 or the first to the fourth pressure reducing control valves 21, 22, 41 and 42. Thus, the W/C pressure is controlled to be a desired control amount.

Further, during antiskid (Antilock Brake System: ABS) control, the first to the fourth pressure increasing control valves 17, 18, 37 and 38 or the first to the fourth pressure reducing control valves 21, 22, 41 and 42 are appropriately controlled. At the same time, the pumps 19 and 39 are driven. Thus, the increase/decrease of the W/C pressure is controlled, and the W/C pressure is controlled to be the desired control amount.

Figure 2:
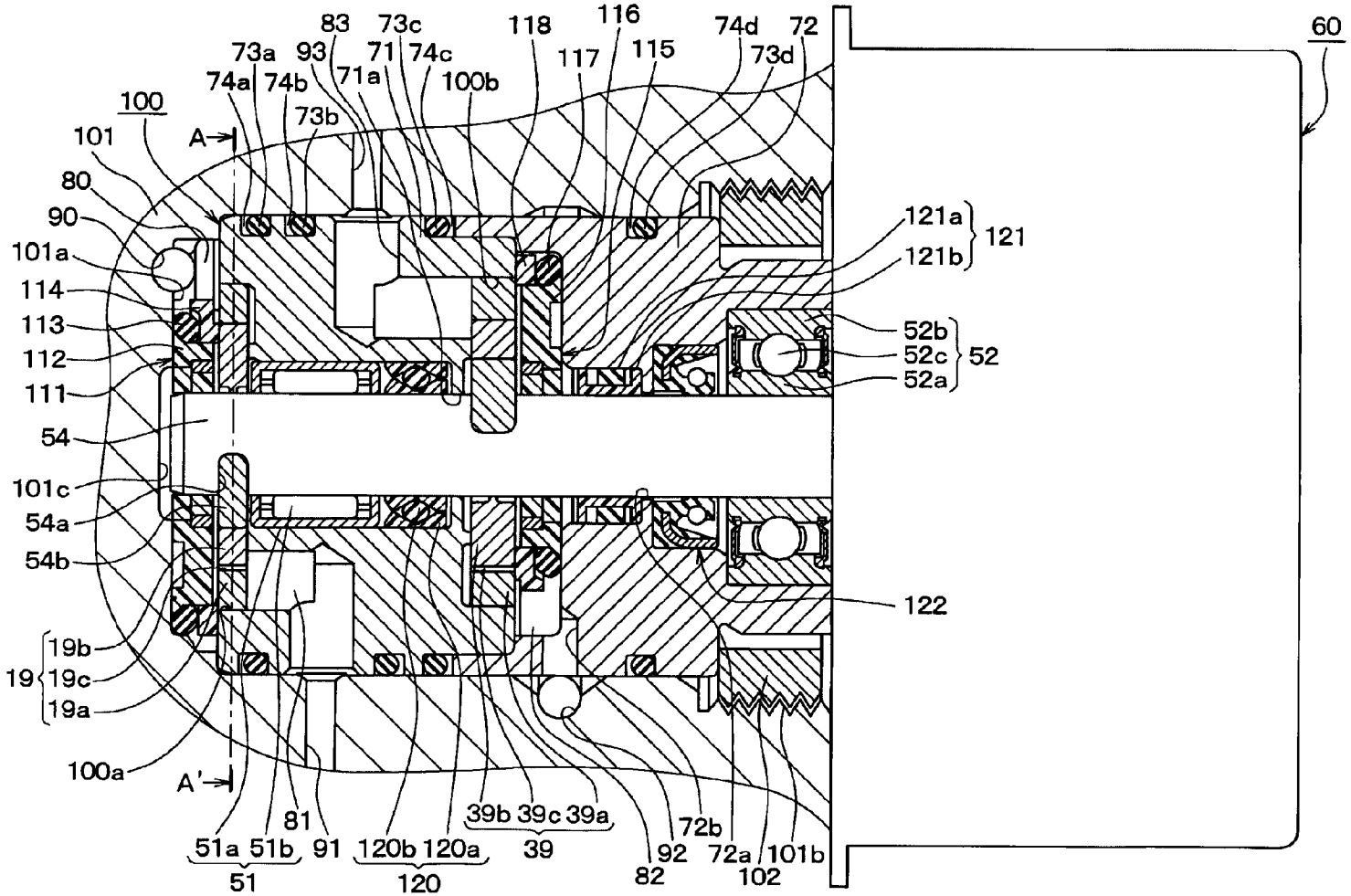
FIG. 2 is a cross-sectional view of a rotary pump device including a motor and a pump body including gear pumps.

Next, a detailed structure of the gear pump device in the vehicle brake device configured as described above will be described. FIG. 2 is a cross-sectional diagram of the gear pump device that is provided with a pump body 100 including the gear pumps 19 and 39, and with the motor 60. The drawing shows a state in which the pump body 100 is mounted into a housing 101 of the brake fluid pressure control actuator 50, and the pump body 100 is mounted such that an up-down direction of the drawing is a vehicle vertical direction.

As described above, the vehicle brake device is formed by the two systems of the first piping system 50*a* and the second piping system 50*b*. Therefore, the pump body 100 is provided with two pumps, i.e., the gear pump 19 for the first piping system 50*a* and the gear pump 39 for the second piping system 50*b*.

The gear pumps 19 and 39 built in the pump body 100 are driven by the motor 60 rotating a drive shaft 54 that is supported by a first bearing 51 and a second bearing 52. A casing that forms an outer shape of the pump body 100 is formed by a cylinder 71 and a plug 72, which are made of aluminum. The first bearing 51 is arranged in the cylinder 71 and the second bearing 52 is arranged in the plug 72.

The cylinder 71 and the plug 72 are integrated such that one end side of the cylinder 71 is press fitted into the plug 72 in a state in which the cylinder 71 and the plug 72 are coaxially arranged, thus forming the casing of the pump body 100. Further, the gear pumps 19 and 39, various types of seal members and the like are provided along with the cylinder 71 and the plug 72, thus forming the pump body 100.

The pump body 100 having an integrated structure is formed in this manner. The pump body 100 with the integrated structure is inserted into a recessed portion 101*a* which is formed in the housing 101 made of aluminum material and has an approximately cylinder shape and, from the right side of the drawing. Then, a ring-shaped male screw member (screw) 102 is screwed into a female screw groove 101*b* that is formed in an entrance of the recessed portion 101*a*, thus fixing the pump body 100 to the housing 101. Since the male screw member 102 is screwed, the pump body 100 is inhibited from being pulled out from the housing 101.

A direction that the pump body 100 is inserted into the recessed portion 101*a* of the housing 101 is hereinafter simply referred to as an insertion direction. Further, an axial direction and a circumferential direction of the pump body 100 (an axial direction and a circumferential direction of the drive shaft 54) are hereinafter simply referred to as an axial direction and a circumferential direction.

Further, a circular-shaped second recessed portion 101*c* is formed in the recessed portion 101*a* of the housing 101, at a leading end position in the insertion direction, more specifically, at a position corresponding to a leading end (left end in FIG. 2) of the rotational shaft 54. The diameter of the second recessed portion 101*c* is made to be larger than the diameter of the rotational shaft 54, and the leading end of the rotational shaft 54 is located in the second recessed portion 101*c* so that the rotational shaft 54 does not come into contact with the housing 101.

The cylinder 71 and the plug 72 are provided with center holes 71*a* and 72*a*, respectively. The rotational shaft 54 is inserted into the center holes 71*a* and 72*a*, and is supported by the first bearing 51 that is fixed to an inner periphery of the center hole 72*a* formed in the cylinder 71 and by the second bearing 52 that is fixed to an inner periphery of the center hole 72*a* formed in the plug 72. Although bearings with any structure may be used as the first and the second bearings 51 and 52, rolling bearings are used in the present embodiment.

Specifically, the first bearing 51 is a needle roller bearing without inner ring, and that is provided with an outer ring 51*a* and a needle-shaped roller 51*b*. The rotational shaft 54 is axially supported by being fitted into a hole of the first bearing 51. At a forward portion in the insertion direction of the center hole 71*a*, the diameter of the center hole 71*a* of the cylinder 71 is enlarged, to have a dimension corresponding to the outer diameter of the first bearing 51. Therefore, the first bearing 51 is fixed to the cylinder 71 by being press fitted into this enlarged diameter portion.

The second bearing 52 is configured such that it includes an inner ring 52*a*, an outer ring 52*b* and a rolling element 52*e*, and it is fixed by the outer ring 52*b* being press fitted into the center hole 72*a* of the plug 72. The rotational shaft 54 is fitted into a hole in the inner ring 52*a* of the second bearing 52, and thus the rotational shaft 54 is axially supported.

Figure 3:
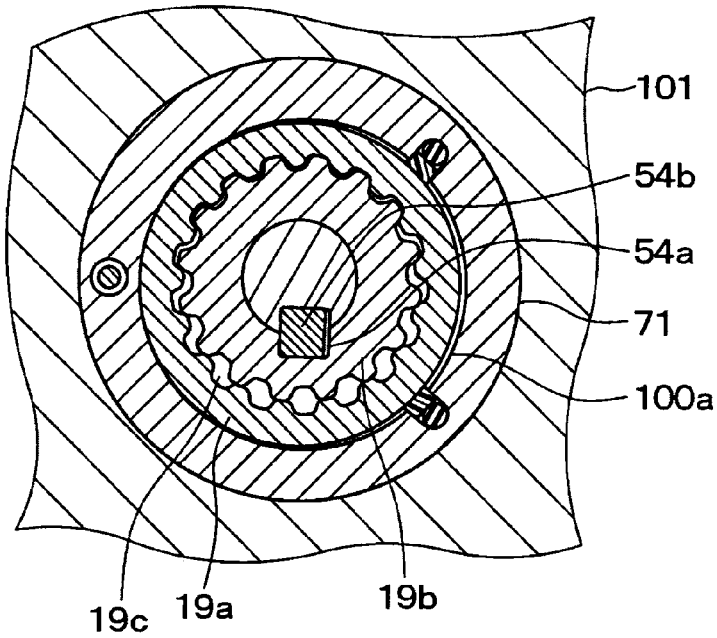
FIG. 3 is a cross-sectional view taken along A-A' of FIG. 2.

The gear pumps 19 and 39 are respectively provided on both sides of the first bearing 51, namely, in an area located further forward in the insertion direction than the first bearing 51, and an area sandwiched by the first and the second bearings 51 and 52. Detailed structures of the gear pumps 19 and 39 will be explained with reference to FIG. 3, which shows an A-A' cross-sectional diagram of FIG. 2.

The gear pump 19 is arranged in a rotor chamber (receiving portion) 100*a*, which is a circular-shaped recessed counter-bore formed in one end face of the cylinder 71. The gear pump 19 is an internal gear pump (a trochoid pump), which is driven by the rotational shaft 54 that is inserted into the rotor chamber 100*a*.

Specifically, the gear pump 19 is provided with a rotating portion that is configured by an outer rotor 19*a* having an inner teeth portion formed on an inner periphery and an inner rotor 19*b* having an outer teeth portion formed on an outer periphery. The rotational shaft 54 is inserted into a hole formed in the center of the inner rotor 19*b*. A key 54*b* is fittingly inserted into a hole 54*a* formed in the rotational shaft 54, and a torque is transmitted to the inner rotor 19*b* by the key 54*b*.

The inner teeth portion and the outer teeth portion that are respectively formed on the outer rotor 19*a* and the inner rotor 19*b* are engaged with each other, and a plurality of void portions 19*c* are thereby formed. Sizes of the void portions 19*c* are changed by rotation of the gear shaft 54, and thus the brake fluid is sucked and discharged.

On the other hand, the gear pump 39 is arranged in a rotor chamber (receiving portion) 100*b*, which is a circular-shaped recessed counter-bore formed in the other end face of the cylinder 71, and the gear pump 39 is driven by the rotational shaft 54 that is inserted into the rotor chamber 100*b*. Similarly to the gear pump 19, the gear pump 39 is also an internal gear pump that is provided with an outer rotor 39*a* and an inner rotor 39*b*, and sucks and discharges the brake fluid using a plurality of void portions 39*c* that are formed by two teeth portions of the outer rotor 39*a* and the inner rotor 39*b* being engaged with each other. The rotary pump 39 is arranged such that the gear pump 19 is rotated by approximately 180 degrees centered on the rotational shaft 54. With this type of arrangement, the suction-side void portions 19*c*, 39*c* and the discharge-side void portions 19*c* and 39*c* of the respective gear pumps 19 and 39 are symmetrically positioned with the rotational shaft 54 as a center. Thus, it is possible to cancel out forces applied to the rotational shaft 54 by a high-pressure brake fluid on the discharge side.

These gear pumps 19 and 39 have the similar structure, but the gear pumps 19 and 39 have different thicknesses in the axial direction. That is, the axial direction length of the gear pump 39, which is provided in the second piping system 50*b* that is a front system, is longer than that of the gear pump 19, which is provided in the first piping system 50*a* that is a rear system. Specifically, each of the rotors 39*a* and 39*b* of the gear pump 39 is longer in its axial direction length than each of the rotors 19*a* and 19*b* of the gear pump 19. Accordingly, the suction and discharge amount of brake fluid in the gear pump 39 is larger than in the gear pump 19, thereby making it possible to supply the brake fluid to the front system more than the rear system.

A seal mechanism 111 that presses the gear pump 19 to a side of the cylinder 71 is provided on an opposite side to the cylinder 71 with respect to the gear pump 19 in the one end face side of the cylinder 71, namely, between the cylinder 71 or the gear pump 19 and the housing 101. Further, a seal mechanism 115 that presses the gear pump 39 to the cylinder 71 side is provided on an opposite side to the cylinder 71 with respect to the gear pump 39 in the other end face side of the cylinder 71, namely, between the cylinder 71 or the gear pump 39 and the plug 72.

The seal mechanism 111 is formed by a ring-shaped member having a center hole into which the rotational shaft 54 is inserted, and seals between a relatively low-pressure section and a relatively high-pressure section on one end face side of the gear pump 19, by pressing the outer rotor 19*a* and the inner rotor 19*b* toward the cylinder 71. Specifically, the seal mechanism 111 achieves a sealing function by being in contact with a desired position of the outer rotor 19*a* or the inner rotor 19*b* and a bottom face of the recessed portion 101*a* that is an outer shell of the housing 101.

The seal mechanism 111 is formed to include an inner member 112 formed in a hollow-frame shape, an annular rubber member 113, and an outer member 114 formed in a hollow-frame shape. The inner member 112 is fitted into the outer member 114 in a state where the annular rubber member 113 is arranged between an outer peripheral wall of the inner member 112 and an inner peripheral wall of the outer member 114.

Figure 4A:
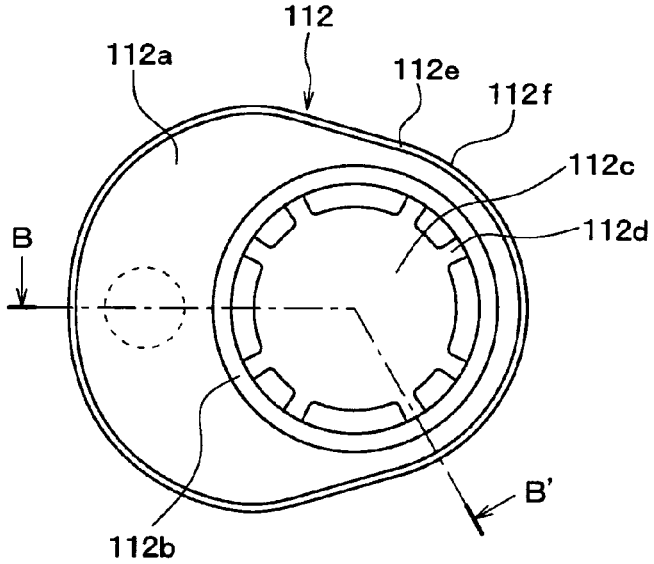
FIG. 4A is a front view of an inner member.
Figure 4B:
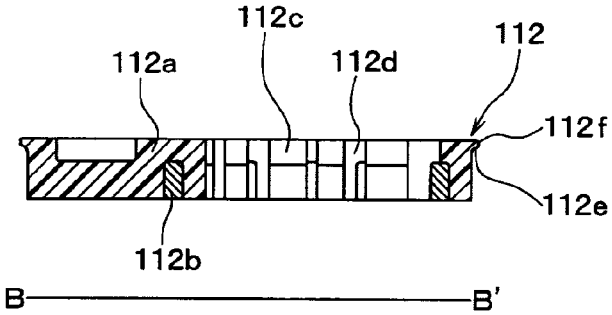
FIG. 4B is the B-B' cross sectional view of FIG. 4A.
Figure 5C:
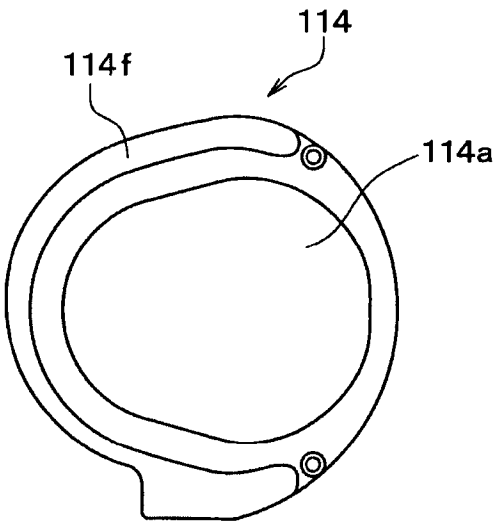
FIG. 5C is a rear view of the outer member.
Figure 5B:
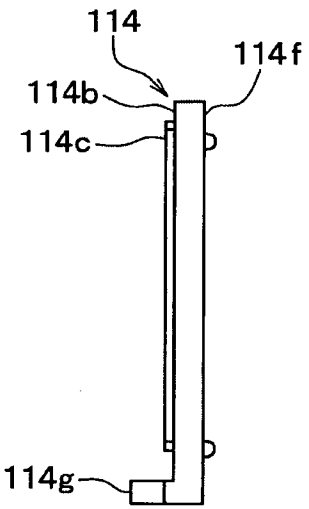
FIG. 5B is a side view of the outer member as viewed from the left side.
Figure 5A:
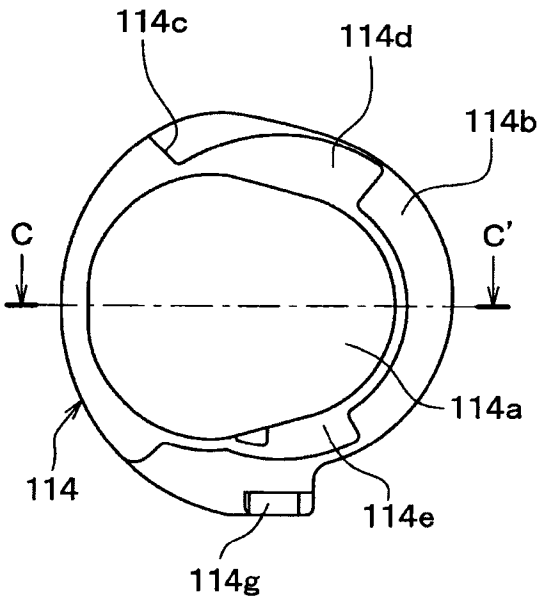
FIG. 5A is a front view of the outer member.
Figure 5D:
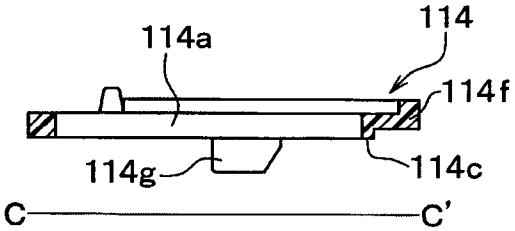
FIG. 5D is a cross sectional view taken along the arrow direction of C-C' shown in FIG. 5A.
Figure 6:
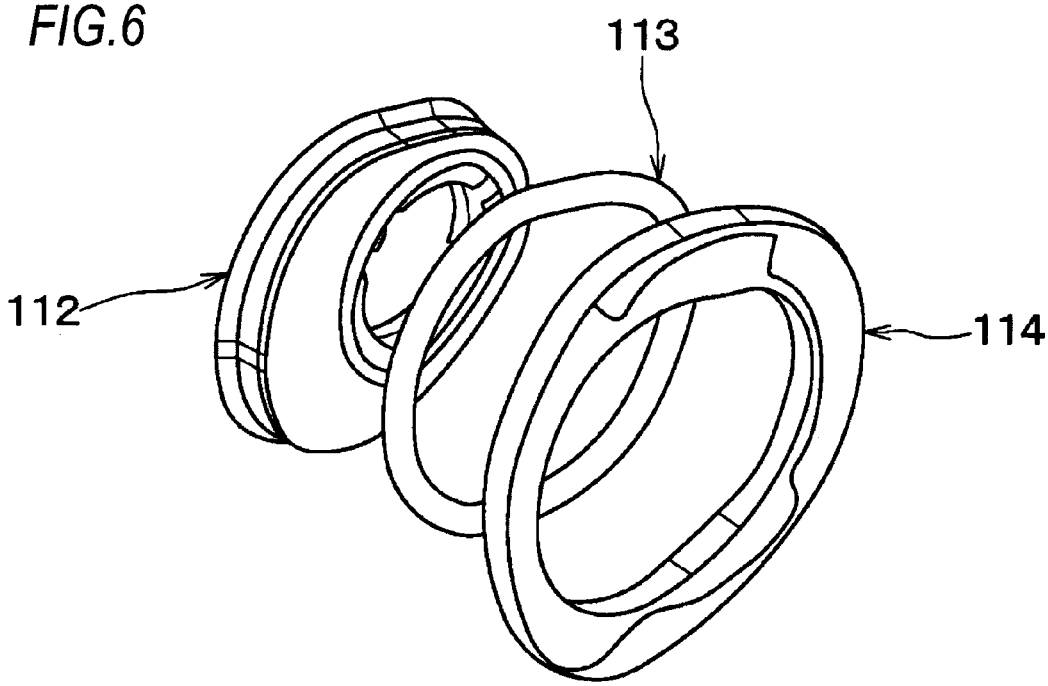
FIG. 6 is a perspective view showing how to fit the inner member into the outer member.

FIGS. 4A to 4B and FIGS. 5A to 5D are diagrams showing a detailed structure of the outer member 114 and the inner member 112. FIG. 4B is a cross sectional view taken along B-B' of FIG. 4A. The cross section of the seal mechanism 111 among the cross section of pump body 100 shown in FIG. 2 is corresponding to a B-B' cross-section of FIG. 4A. FIG. 5A is a front view of the outer member 114, FIG. 5B is a side view of the outer member 114 as viewed from the right side of FIG. 5A, FIG. 5C is a rear view of the outer member 114, and FIG. 5D is a cross sectional view taken along C-C' of FIG. 5A. FIG. 6 is a perspective view showing how to fit the inner member 112 into the outer member 114. Hereinafter, the structures of each of the elements 112 to 114 configuring the seal mechanism 111 will be described with reference to the drawings.

As shown in FIGS. 4A and 4B, the inner member 112 is formed by a resin portion 112 and a metallic ring 112*b*, which are integrated by the metallic ring 112*b* integrally being molded (insert molding) with the resin portion 112*a* during molding of the resin portion 112*a*.

The resin portion 112*a* is formed in a hollow-frame shape formed by a hollow portion 112*c* in which the rotational shaft 54 is disposed. The hollow portion 112*c* may have a circular shape to match the outer peripheral shape of the rotational shaft 54, but a diameter there of is partially enlarged to be larger than the rotational shaft 54 by a plurality of slits 112*d* being formed along the axial direction. A metal ring 112*b* is disposed concentrically with respect to the hollow portion 112*c*. The metallic ring 112*b* is provided for reinforcement of the resin portion 112*a* as well as the surroundings of the hollow portion 112*c*.

Further, a portion of the resin portion 112*a*, in which the slit 112*d* is not formed, is protruded more inwards than the metallic ring 112*b*, and a portion the resin portion 112*a*, in which the slit 112 is formed, is recessed to a position of the metallic ring 112*b*. The distance from a portion of inner wall of the hollow portion 112*c*, which is not the slit 112*d*, to a center of the hollow portion 112*c* is designed to meet the diameter of the rotational shaft 54.

In the above configuration, since a portion of the inner member 112, which serves as a sliding surface of the rotary shaft 54 is a portion formed with no slits 112*d* among the hollow portion 112*c*, it is possible for the metallic ring 112*b* not to be in contact with the rotational shaft 54. Meanwhile, if the inner wall face of the hollow portion 112*c* is formed by the metallic ring 112*b* to thereby serve as a surface being in contact with the rotational shaft 54, the gap between the outer peripheral face of the rotational shaft 54 and the inner wall face of the hollow portion 112*c* is to be adjusted according to the dimensional tolerance of the metallic ring 112*b*, so that positioning of the rotational shaft 54 is to be performed in a radial direction. However, since the metallic ring 112*b* and the rotational shaft 54 are in contact with each other, it is necessary for materials different from each other in order to suppress a seizing due to sliding of the rotational shaft 54. For example, the rotational shaft 54 may be made of SUS and the metallic ring 112*b* may be made of copper. However, since copper is a relatively soft material compared with SUS or the like, the function of reinforcement of the resin portion 112*a* becomes insufficient if a certain degree of thickness thereof is not ensured. In contrast, as in the present embodiment, if the resin portion 112*a* is in contact with the rotational shaft 54 and the metallic ring 112*b* is not in contact with the rotational shaft 54, the material is not to be problem for the metallic ring 112*b*, so that it is possible to form the metallic ring 112*b*, for example, with the same material as the rotational axis 54. Therefore, degree of freedom in material selection can be improved. Then, if the metallic ring 112*b* is formed with a relatively hard material such as SUS and the like, it becomes possible to reduce the plate thickness as compared with the case of using a relatively soft material such as copper and it is thereby possible to reduce material costs as well.

The inner member 112 has a diameter smaller than the void portion 19*c* at a right side of FIG. 4A, i.e., a position corresponding to a high-pressure discharge side of the gear pump 19, and a diameter larger than the void portion 19*c* at a left side of the drawing, i.e., a position corresponding to a low-pressure suction-side of the gear pump 19. Therefore, when the annular rubber member 113 is fitted to the outer peripheral wall of the inner member 112, the peripheral portion of the rotational shaft 54 or the suction-side of the gear pump 19, which are at a low pressure, may be disposed on the inner side of the annular rubber member 113, and the discharge side of the gear pump 19, which is at a high pressure, may be located at the outer side of the annular rubber member 113.

Further, since the annular rubber member 113 is pressed inwards in a radial direction as a high discharge pressure is applied to the annular rubber member 113 when the brake fluid is sucked and discharged by the gear pump 19, the peripheral wall of the inner member 112 serves as a pressure receiving face that receives the pressure inwards in the radial direction from the annular rubber member 113. The pressure receiving face is configured such that the inner member 112 generates a propulsive force in a direction away on the axial direction from the gear pump 19, and in the present embodiment, a portion of the pressure receiving face has a tapered face 112*e*. More specifically, a flange portion 112*f* surrounding the outer peripheral wall of the inner member 112 is provided on the opposite side of the gear pump 19, and a face of the gear pump 19 side among the flange portion 112*f* has the tapered face 112*e*.

The annular rubber member 113 is an O-ring or the like, fitted to the outer peripheral wall of the inner member 112, and disposed between the outer member 114 and inner member 112. The annular rubber member 113 increases the contact pressure on the pressure receiving face of the inner member 112 as the discharge pressure increases during operation of the gear pump 19, and at the same time, keeps in contact with the bottom face of the recessed portion 101*a* thereby serving as a seal member between the discharge side of the gear pump 19, which is at a high pressure, and the peripheral portion of the rotational shaft 54 or the suction side of the gear pump 19, which is at a low pressure. The annular rubber member 113 is formed in a shape according to the outer shape of the inner member 112, but it may be deformed elastically from a circular shape to be fitted on the outer shape of the inner member 112 and to be fitted on the peripheral wall of the inner member 112.

The outer member 114 seals between the high pressure side and the low pressure side on an axial direction end face of the gear pump 19. As shown FIGS. 5A, 5C, and 5D, the outer member 114 is formed in a hollow-frame shape, and the inner shape of the hollow portion 114*a* is a shape corresponding to the outer shape of the inner member 112. Further, the outer member 114 is formed with a stepped plate having a convex portion 114*c* and a recessed portion 114*b* that are formed on the end face of a side of the gear pump 19, and the convex portion 114*c* is in contact with one end face of both of the rotors 19*a* and 19*b*.

The convex protrusion 114*c* has a seal portion 114*d* and a seal portion 114*e*. The seal portion 114*d* and seal portion 114*e* are provided respectively at corresponding positions during the period of transition from a state where the void portion 19*c* is in communication with a suction inlet 81, which will be described later, to a state where the void portion 19*c* is in communication with a discharge chamber 80, which will be described later, and during the period of transition from a state where the void 19*c* is in communication with the discharge chamber 80 to a state where the void portion 19*c* is in communication with the suction inlet 81. By the seal portions 114*d* and 114*e*, the void portion 19*c* is closed and at the same time the gap between the high pressure side and the low pressure side is sealed. The recessed portion 114*b* is communicated with the discharge chamber 80, thereby introducing a high discharge pressure therein. Therefore, the high discharge pressure is introduced into the outer periphery of the outer member 114 as well as in the recessed portion 114*b* during the high-pressure discharge by the gear pump 19. Due to the discharge pressure, the outer member 114 may be deformed, causing the sticky clutch to tighten the inner member 112.

Further, the inner member 112 and annular rubber member 113 are adapted to be fitted to the outer member 114 from the opposite side of the gear pump 19, and a protruding wall 114*f* having a shape corresponding to the annular rubber member 113 is formed on the end face of the outer member 114 at an opposite side to the gear pump 19. Since the annular rubber member 113 is disposed to face the inner peripheral wall of the protruding wall 114*f*, the annular rubber member 113, the inner member 112 and the outer member 114 are accurately arranged.

Incidentally, as shown FIGS. 5A, 5B, and 5D, a protruding rotation preventing portion 114*g* is formed on a portion which located outer side in a radial direction than the convex portion 114*c* at the end face at the side of the gear pump 19 in the outer member 114. The rotation preventing portion 114*g* is inserted into a concave portion (not shown) formed in the cylinder 71, so that the outer member 114 is not rotated relative to the cylinder 71.

The outer diameter of the seal mechanism 111 is smaller than the inner diameter of the recessed portion 101*a* of the housing 101, as viewed above the sheet of FIG. 2. Accordingly, a brake fluid may flow through the gap between the seal mechanism 111 and the recessed portion 101*a* of the housing 101. The gap forms a discharge chamber 80 and is connected to a discharge conduit 90 formed on a bottom portion of the recessed portion 101*a* of the housing 101. According to this structure, the gear pump 19 is able to discharge the brake fluid using the discharge conduit 90 and the discharge chamber 80 as discharge paths.

The cylinder 71 is provided with the suction inlet 81 which communicates with the void portion 19*c* of a suction side of the gear pump 19. The suction inlet 81 is extended from an end face at the side of the gear pump 19 to an outer peripheral face of the cylinder 71, and is connected to a suction conduit 91 provided on a side face of the recessed portion 101*a* of the housing 101. According to this structure, the gear pump 19 is able to suck the brake fluid using the suction inlet 81 and the suction conduit 91 as suction paths.

On the other hand, the seal member 115 is also formed with a ring shaped member having a central portion into which the rotational shaft 54 is inserted, and presses the outer rotor 39*a* and the inner rotor 39*b* towards the cylinder 71, thereby sealing a relatively high-pressure section and a relative low-pressure section at one end face side of the gear pump 39. Specifically, the seal mechanism 115 has a sealing function by coming into contact with an end face of a portion of the plug 72, which receives the seal mechanism 115 and a desired position of the outer rotor 39*a* or the inner rotor 39*b*.

The seal mechanism 115 is configured to have an inner member 116 which is a hollow-frame shape, an annular rubber member 117, and an outer member 118 which is a hollow-frame shape, and the inner member 116 is fitted into the outer member 118 in a state where the annular rubber member 117 is arranged between an outer peripheral wall of the inner member 116 and an inner peripheral wall of the outer member 118. Since the seal mechanism 115 is different from the seal mechanism 111 in that its sealing face is in the opposite side thereto, the seal mechanism 115 is formed in a symmetrical shape with respect to the seal mechanism 111, but arranged out of phase by 180 degrees with respect to the seal mechanism 111, centered on the rotational shaft 54. However, since the basic structure of the seal mechanism 115 is the same as that of the seal mechanism 111, descriptions for the detailed structure of the seal mechanism 115 will be omitted.

On the other hand, the outer diameter of the seal mechanism 115 is smaller than the inner diameter of the plug 72 in a left side of the figure. Therefore, the brake fluid can flow through the gap between the seal mechanism 115 and the plug 72 in the left side of the figure. The gap forms a discharge chamber 82 and is connected to a communication passage 72*b* formed in the plug 72 and a discharge conduit 92 formed on a side face of the recessed portion 101*a* of the housing 101. According to this structure, the gear pump 39 is able to discharge the brake fluid using the discharge chamber 82 or the communication passage 72*b* and the discharge conduit 92 as discharge paths.

Incidentally, the end face at a side of the gear pumps 19 and 39 of the cylinder 71 is a sealing face, and the gear pumps 19 and 39 is close contact with the sealing face to be mechanical-sealed. Accordingly, a relatively low-pressure section and a relatively high-pressure section, which are located on the other end face side of the gear pumps 19 and 39, are sealed.

Further, the cylinder 71 is provided with the suction inlet port 83 which communicates with the void portion 39*c* of a suction side of the gear pump 39. The suction inlet 83 is extended from an end face at a side of the gear pump 39 to an outer peripheral face of the cylinder 71 and is connected to a suction conduit 93 provided on a side face of the recessed portion 101*a* of the housing 101. According to this structure, the gear pump 19 is able to suck the brake fluid using the suction inlet 83 and the suction conduit 93 as suction paths.

Incidentally, as shown in FIG. 2, the suction conduit 91 and the discharge conduit 90 are corresponding to the conduit C shown in FIG. 1, and the suction conduit 93 and the discharge conduit 92 are corresponding to the conduit G shown in FIG. 1.

Further, a seal member 120 which is formed by an annular resin member 120*a* in which its radial direction cross section is U-shaped and an annular rubber member 120*b* which is fitted into the annular resin member 120*a* are accommodated further rearwards in an insertion direction than the first bearing 51 of the center hole 71*a* of the cylinder 71. The annular resin member 120*a* is pressed and compressed by the cylinder 71 and the rotational shaft 54 thereby crushing the annular rubber member 120*b*. The annular resin member 120*a* comes in contact with the cylinder 71 and the rotational shaft 54 by the repulsive force of the annular rubber member 120*b*, and thus the seal member 120 seals therebetween. Thus, the seal between the two systems in the center hole 71*a* of the cylinder 71 is achieved.

The center hole 72*a* of the plug 72 is formed in a stepped shape such that its inner diameter is reduced in three steps as forwarding from a front side of the insertion direction to a rear side thereof, and the seal member 121 is accommodated on a first stepped portion at the rearmost side of the insertion direction. The seal member 121 is formed such that an elastic ring 121*a* of ring shape made of an elastic member such as rubber and the like is fitted into an annular resin member 121*b* having a recess formed in a depth direction as a radial direction, and the resin member 121*b* is pressed by the elastic force of the elastic ring 121*a* to be in contact with the rotational shaft 54.

The seal mechanism 115, as described above, is accommodated on a second stepped portion which is next to a stepped portion on which the seal member 121 of the center hole 72*a* is disposed. The communication passage 72*b*, as described above, is formed from the stepped portion to the outer peripheral face of the plug 72. Further, the end portion of the rear side of the cylinder 71 in the insertion direction is press-fitted on the third stepped portion which is a frontmost side of the center hole 72*a* in the insertion direction. A outer diameter of a portion, which is fitted into the center hole 72*a* of the plug 72, of the cylinder 71 is reduced to be smaller than the other portion of the cylinder 71 of the cylinder 71. Since the axial direction dimension of the portion that the outer diameter of the cylinder 71 is reduced is greater than the axial direction dimension of the third stepped portion of the center hole 72*a*, a groove 74*c* is formed at a front end position of the plug 72 by the cylinder 71 and the plug 72 when the cylinder 71 is fittingly inserted into the center hole 72*a* of the plug 72.

Furthermore, a diameter of the center hole 72*a* of the plug 72 is partially enlarged at the rear portion in the insertion direction, and an oil seal (seal member) 122 is provided in this portion. As described above, the oil seal 122 is arranged at a side of the motor 60 than the seal member 121, thereby basically suppressing a brake fluid from being leaked outwards through the center hole 72*a* by the seal member 121, and by the oil seal 122, its effect may be obtained more reliably.

O-rings 73*a* to 73*d* as annular seal member are provided in the outer periphery of the pump body 100 configured in such a manner to seal the each portion. These O-rings 73*a* to 73*d* serve to seal a brake fluid between the two systems formed in the housing 101, or between a suction path and a discharge path of each system. The O-ring 73*a* is arranged between both the discharge chamber 80 and the discharge conduit 90 and both the suction inlet 81 and the suction conduit 91, the O-ring 73*b* is arranged between both the suction inlet 81 and the suction conduit 91 and both the suction inlet 83 and the suction conduit 93, the O-ring 73*c* is arranged between both the suction inlet 83 and the suction conduit 93 and both the discharge chamber 82 and the charge conduit 92, and the O-ring 73*d* is arranged between both the charge chamber 82 and the charge conduit 92 and the outside of the housing 101. Although the O-rings 73*a*, 73*c* and 73*d* are simply arranged in a circular shape to surround a circumferential direction about the rotational shaft 54, the O-ring 73*b* surrounds the circumferential direction about the rotational shaft 54 but is arranged with shifting in an axial direction, thereby enabling the size reduction in the axial direction of the rotational shaft 54.

In addition, grooves 74*a* to 74*d* are provided on the outer periphery of the pump body 100 so that the O-rings 73*a* to 73*d* will be arranged therein. The grooves 74*a* and 74*b* are formed by partially recessing the outer periphery of the cylinder 71. The groove 74*c* is formed by the recessed portion of the outer periphery of the cylinder 71 and the front end portion of the plug 72. The recessed portion 74*d* is formed by partially recessing the outer periphery of the plug 72. The pump body 100 is inserted into the recessed portion 101*a* of the housing 101 in a state where the O-rings 73*a* to 73*d* are fitted into each of the grooves 74*a* to 74*d*, thereby each of the O-rings 73*a* to 73*d* are crushed on an inner wall face of the recessed portion 101*a*, thus functioning as a seal.

Further, a diameter of the outer peripheral face of the plug 72 is reduced in at the rear side of the insertion direction, thereby forming a stepped portion. The male screw member 102 having a ring shape, as described above, is fitted to the portion the diameter of which has been reduced, and the pump body 100 is thereby fixed.

The gear pump device is configured as described above. The above gear pump device performs a pumping operation such as suction and discharge of brake fluid by the rotation of the rotational shaft 54 installed in gear pumps 19 and 39 by the motor 60. Accordingly, a vehicle motion control such as antiskid control and the like is performed by the vehicle brake system.

Further, in the gear pump device, the discharge pressure of each of the gear pumps 19 and 39 is introduced into the discharge chambers 80 and 82 in accordance with the pump operation. Thereby, the discharge pressure of high pressure is applied to the end face, which is at an opposite side to the gear pumps 19 and 39, of the outer members 114 and 118 provided in both the seal mechanisms 111 and 115. Therefore, the discharge pressure of high pressure is applied in a direction of pressing the outer members 114 and 118 towards the cylinder 71, thereby pressing a seal face of the outer members 114 and 118 (distal end surface of the convex portion 114*c* in referring to the sealing mechanism 111) on the rotary pumps 19 and 39 and pressing the other axial direction end face of the rotary pumps 19 and 39 on the cylinder 71. Thus, it is possible to achieve the mechanical seal the other axial direction end face of the rotary pumps 19 and 39 by the cylinder 71 while sealing the axial direction end face of the rotary pumps 19 and 39 by both the seal mechanisms 111 and 115.

Figure 7:
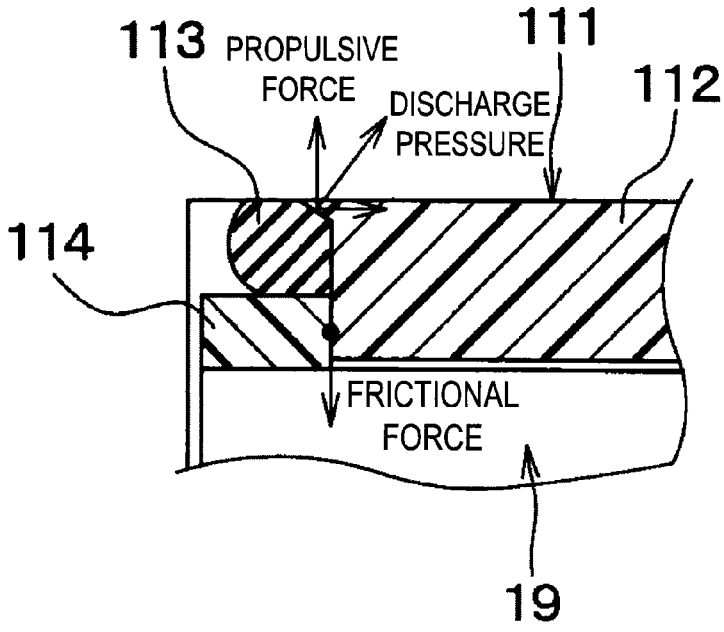
FIG. 7 is a schematic sectional view showing a force applied to a pressure-receiving face.

When the discharge pressure of each of the gear pumps 19 and 39 is introduced into the discharge chambers 80 and 82 in accordance with the pump operation, the annular rubber members 113 and 117 serve to press vertically the pressure-receiving face of the inner members 112 and 116 based on the discharge pressure. FIG. 7 is a schematic cross-sectional view illustrating a force applied to the pressure receiving face at this time. As shown in this figure, the pressure receiving face of the inner member 112 is pressed in the vertical direction of the face, thereby generating a propulsive force in a direction that the inner member 112 goes away from the gear pump 19. The inner member 112 comes into contact with the bottom face of the recessed portion 101*a*, so that it is possible to eliminate the gap therebetween. The same may be applied to the inner member 116. Since the pressure receiving face of the inner member 116 is pressed in the vertical direction of the face, thereby generating a propulsive force in a direction that the inner member 116 goes away from the gear pump 39, the inner member 116 is contacted on the end face of the plug 72, so that it is possible to eliminate the gap therebetween.

Furthermore, the annular rubber members 113 and 117 are pressed on the bottom face of the recessed portion 101*a* or the end surface of the plug 72 by the discharge pressure of high pressure. Therefore, it is possible for the annular rubber member 113 and the inner member 112 to seal the low pressure side and the high pressure side that are at inner side and outer side with respect to the annular rubber member 113, respectively. At the same time, it is possible to seal the low pressure side and the high pressure side, which are respectively corresponding to inner side and outer side with respect to the annular rubber member 113, by the annular rubber member 117 and the inner member 116.

As such, the inner members 112 and 116 are contacted on the bottom face of the recessed portion 101*a* or the end face of the plug 72 thereby eliminating the gap therebetween, and at the same time, enabling to accurately seal the low pressure side and the high pressure side. Therefore, it is possible to suppress pressure leakage when a gap is formed between them, or durability deterioration when the annular rubber member 113 enters the gap and is abnormally deformed. Further, since the annular rubber member 113 increases or decreases the contact pressure on the pressure receiving face of the inner member 112 in accordance with the increase or decrease of the discharge pressure during operation of the gear pump 19, it is possible to suppress the generation of loss torque.

Specifically, according to the present embodiment, the pressure-receiving face is made as the tapered face 112*e*. For that reason, the discharge pressure applied in a direction perpendicular to the tapered face 112*e* during discharge of high pressure may be converted efficiently into the propulsive force by which the inner members 112 and 116 can move towards the opposite side of the gear pumps 19 and 39. Therefore, it is possible to eliminate the gap more reliably, thereby enabling to obtain the effect.

Incidentally, although the angle of the tapered face 112*e* is arbitrary, the angle is designed to meet the following conditions. That is, since tightening of the inner member 112 due to the deformation of the outer member 114, i.e., clutching of the inner member 112 by the outer member 114 may be generated during a high-pressure discharge by the gear pump 19, the angle design is made so that the propulsive force generated in a direction that the inner member 112 goes away from the gear pump 19 may be greater than a frictional force (see FIG. 7) generated due to such cases. For example, when the angle formed between both sides of the distal end portion of the flange portion 112*f*, that is, the face being contacted on the recessed portion 101*a*, which is of the inner member 112, and the tapered face 112*e* is 60 degrees, the conditions may be satisfied. Therefore, it is possible to obtain the effects on the basis of the angular design of the tapered face 112*e*. It may be same even with respect to the tapered face of the inner member 116.

Meanwhile, when the discharge pressure is applied to the discharge chambers 80 and 82, it is not need that the annular rubber members 113 and 117 are contacted on the outer members 114 and 118. However, in the present embodiment, these are in contact with each other. Since the clamping force of the inner members 112 and 116 by the outer members 114 and 118 increases due to the increase of the discharge pressure, even if the outer members 114 and 118 and the annular rubber members 113 and 117 are not in contact with each other, the leakage in the discharge pressure will be suppressed from the contacting portion of the inner members 112 and 116 and the outer members 114 and 118. However, if the annular rubber members 113 and 117 and the outer members 114 and 118 are contacted on each other, since the leakage in the discharge pressure to the contacting portion side of the inner members 112 and 116 and the outer members 114 and 118 can be prevented, it is possible to further improve the effect of preventing the leakage of the discharge pressure from the contacting portion between the inner members 112 and 116 and the outer members 114 and 118.

Further, as in the present embodiment, resin components that are provided in the seal mechanisms 111 and 115 may be divided into resin portions of the inner members 112 and 116 and resin portions of the outer members 114 and 118. Accordingly, each of the resins forming these may be different materials. In this case, the outer members 114 and 118 requiring durability and abrasion resistance may be formed with a resin such as PEEK (polyether ether ketone) and the like, and a resin portion of the inner members 112 and 116 that does not require durability and abrasion resistance compared with the outer members 114 and 118 may be formed with PPS (polyphenylene sulfide) and the like. Therefore, it is possible to achieve a reduction in material cost.

Second Embodiment

Figure 8:
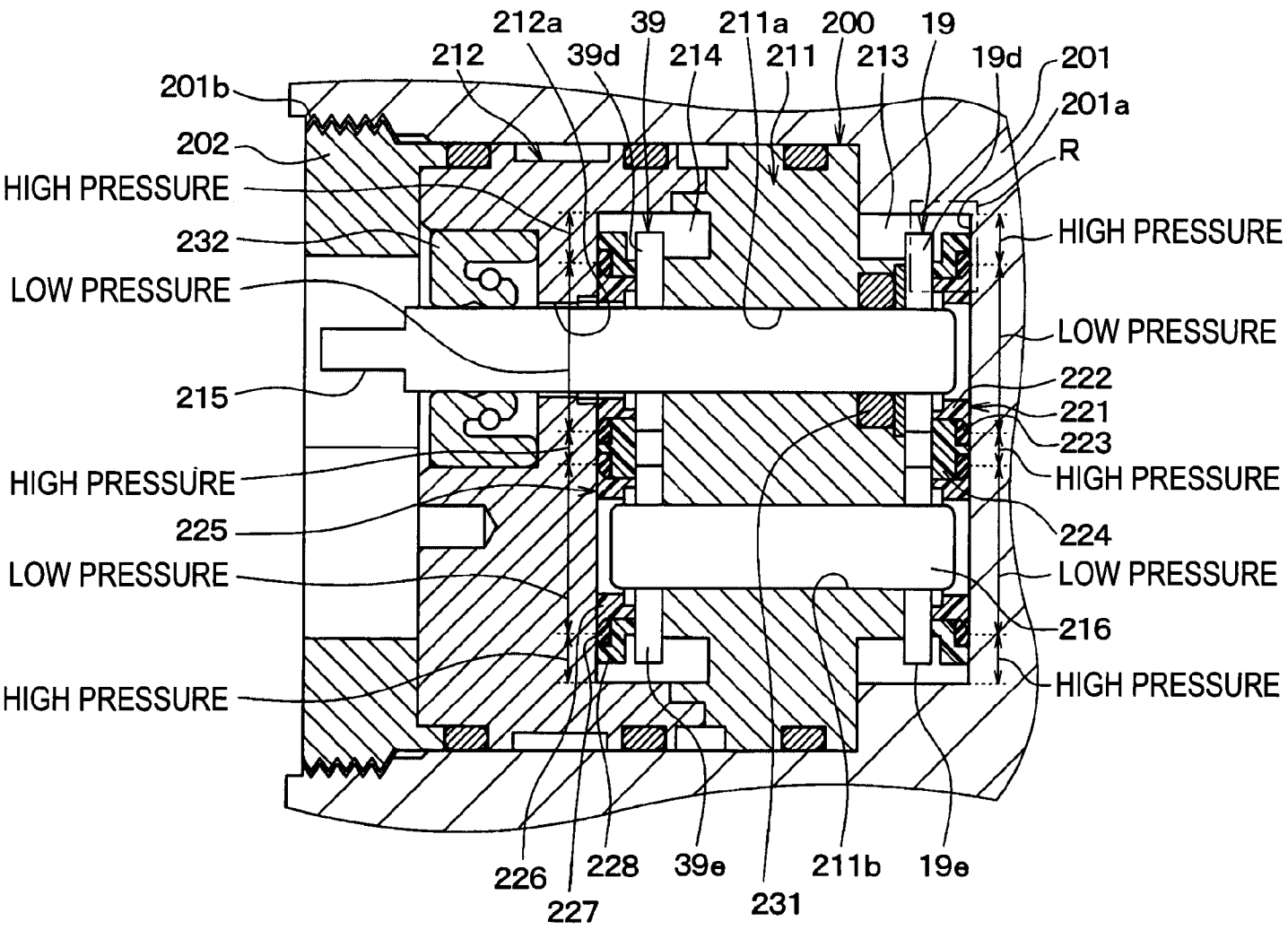
FIG. 8 is a cross-sectional view of a gear pump device to which a external gear pump according to a second embodiment of this disclosure is applied.

In the first embodiment, the case of using the internal gear pump as the gear pumps 19 and 39 has been described. However, in the present embodiment, the case of using an external gear pump will be described. FIG. 8 shows a cross-sectional view of a gear pump device according to the present exemplary embodiment. A structure of the gear pump device will be described with reference to the drawing.

As shown in FIG. 8, the pump body 200 with gear pumps 19 and 39 is inserted into the recessed portion 201*a* formed in the housing 201. Then, in the insertion direction rear side of the pump body 200, a ring-shaped male screw member (screw) 202 is screwed into a female screw groove 201*b* that is formed in an entrance of the recessed portion 201*a*, so that the pump body 200 is fixed to the housing 101.

In the pump body 200 with the gear pumps 19 and 39, the gear pump 19 is arranged at a bottom side of the recessed portion 201*a* lower than the gear pump 39, a cylinder 211 is disposed between both the gear pumps 19 and 39, and a plug 212 is arranged at an opposite side of the cylinder 211 with respect to the gear pump 39 disposed there-between, that is, at an inlet side of the recessed portion 201*a*. A recess in which the gear pump 19 is accommodated is formed in the bottom portion of the recessed portion 201*a*, and a pump chamber (receiving portion) 213 is formed by a space formed by the recess and an end face of the cylinder 211. Further, a recess in which the gear pump is accommodated is formed even on an end face of the plug 212, at a side where the gear pump 39 is disposed, and a pump chamber (receiving portion) 214 is formed by a space formed by the recess and an end face of the cylinder 211.

In the cylinder 211 and the plug 212, shaft holes 211*a* and 212*a* that are opened on the same axis are formed, and a drive shaft 215 is arranged to pass through the shaft holes 211*a* and 212*a*. A drive gear 19*d* of the gear pump 19 is fitted into a portion of the drive shaft 215, which is disposed between the cylinder 211 and the bottom portion of the recessed portion 201*a*, and a drive gear 39*d* of the gear pump 39 is fitted into a portion of the drive shaft 215, which is disposed between the cylinder 211 and the plug 212. Further, in the cylinder 211, an opened shaft hole 211*b* is formed at a position that is apart by a predetermined distance from the shaft hole 211*a*, and a driven shaft 216 is arranged to pass through the shaft hole 211*b*. A driven gear 19*e* of the gear pump 19 is fitted to the front end position of the driven shaft 216, at the bottom side of the recessed portion 201*a* and a driven gear 39*e* of the gear pump 39 is fitted to the front end position of the other side.

Then, a seal mechanism 221 is provided between the gear pump 19 and the bottom of the recessed portion 201*a*, and a seal mechanism 221 is provided between the gear pump 39 and the plug 212.

According to such a configuration, when the drive shaft 215 and the drive gears 19*d* and 39*d* are rotated along with the operation of the motor 60 shown in FIG. 1, the driven gears 19*e* and 39*e* are also rotated centered on the driven shaft 216 by the engagement of the teeth formed in the drive gears 19*d* and 39*d* and driven gears 19*e* and 39*e*. Thus, in each of the pump chambers 213 and 214, the brake fluid is sucked using, as a suction chamber, one region defined by the drive gears 19*d*, 38*d*, the driven gears 19*e* and 39*e* and the peripheral wall, and the brake fluid of high pressure is discharged using the other region as a discharge chamber.

Incidentally, a seal member 231 is disposed in the shaft hole 211*a* of the cylinder 211. Further, a recess is formed in the end face of the plug 212, which is at an opposite side to the end face side where the gear pump 39 is disposed, and a seal member 232 is also disposed within the recess. By these seal members 231 and 232, a seal may also be achieved between the gear pumps 19 and 39, or between each gear pump 39 and the outer.

As such, according to the gear pump device provided with the gear pumps 19 and 39 formed with the external gear pump, the seal mechanisms 221 and 225 serve to press the end face of each of the gear pumps 19 and 39, thereby sealing the suction-side with low pressure and the discharge side with high pressure. The same structure according to the first embodiment may also be applied to the seal mechanisms 221 and 225.

Figure 9:
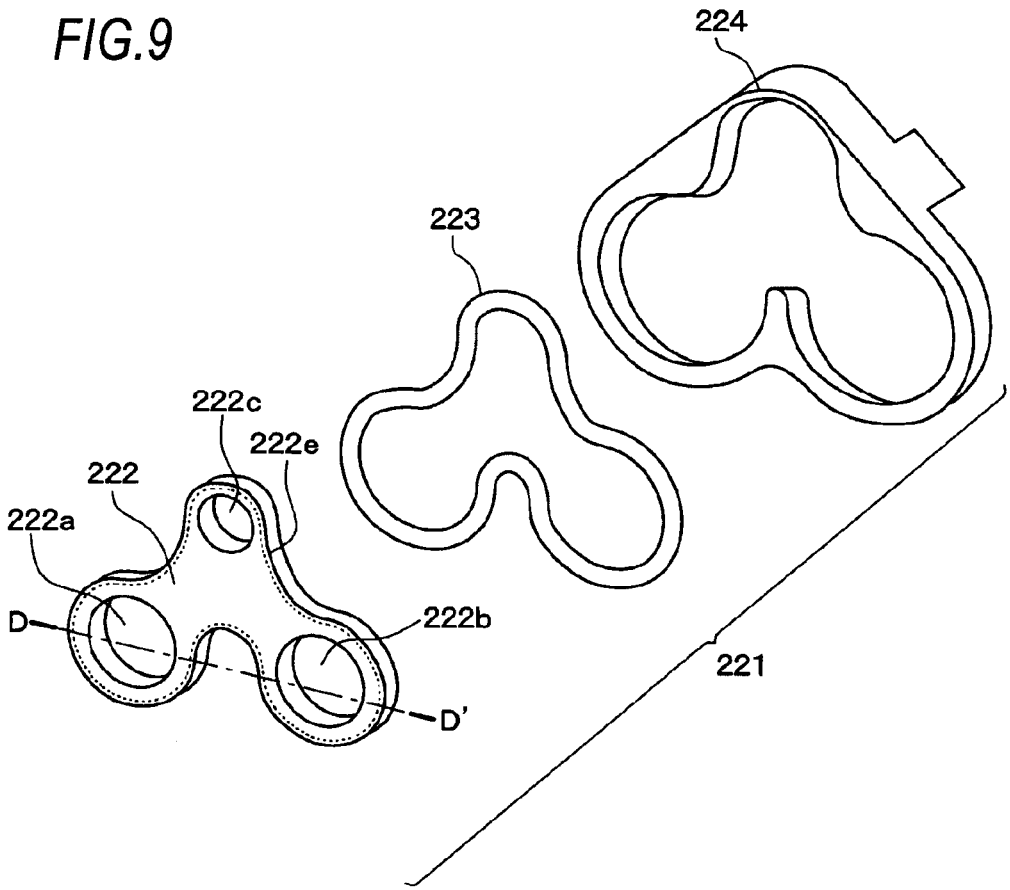
FIG. 9 is an exploded perspective view of the seal mechanism in the second embodiment and FIG. 10 is an enlarged view showing the region R of FIG. 8, i.e., the seal mechanism, during the pump operation.
Figure 10:
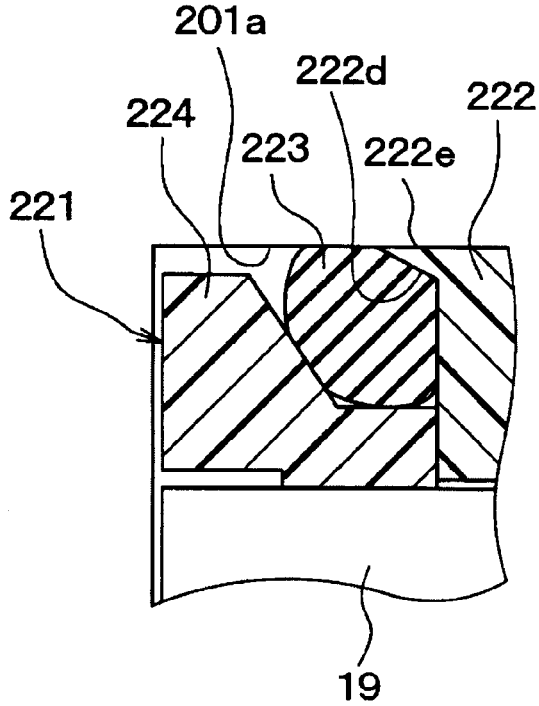

FIG. 9 is a perspective exploded view of a seal mechanism 221. FIG. 8 is a view showing a portion corresponding to the cross section of the position corresponding to the line D-D'. In addition, FIG. 10 is an enlarged view showing the region R of FIG. 8, that is, the appearance of the seal mechanism 221.

As shown in FIG. 9, the seal mechanism 221 is formed with an inner member 222, an elastic rubber member 223 and an outer member 224, and is formed in a nearly triangular shape corresponding to the cylinder 211.

The inner member 222 is made of a resin, and surrounds the drive shaft 215 and the driven shaft 216 to a seal between the suction side of low pressure, the surroundings of the shafts 215 and 216 and the discharge side of high pressure, along with the annular rubber member 223. In the inner member 222, the openings 222*a* and 222*b* are formed at positions corresponding to the shaft holes 211*a* and 211*b* formed in the cylinder 211. Also, a suction inlet 222*c* communicated with the suction chamber at a side of the gear pump 19 is formed on a line orthogonal to a line segment connecting each of the openings 222*a* and 222*b*. During the operation of the pump, the brake fluid is sucked into the suction chamber through the suction inlet 222*c*, and a suction operation is performed by the gear pump 19. The inner member 222 is formed in a nearly triangular shape, in which three circular frames surrounding the peripheries of these openings 222*a* and 222*b* and suction inlet 222*c* are connected.

When the suction/discharge operation of the brake fluid is performed by the gear pump 19, since the discharge pressure of high pressure is applied to the annular rubber member 223 and the annular rubber member 223 is thereby pressed inwards, the outer peripheral wall 222 serves to form a pressure receiving face which receives the pressure inwards in a radial direction from the annular rubber member 223. The pressure receiving face is configured to generate a propulsive force in a direction away from the gear pump 19 in the axial direction of the inner member 222. In this embodiment, a portion of the pressure receiving face is made as a tapered face 222*d*, as shown in FIG. 10. More specifically, a flange portion 222*e* so as to make a circuit the outer peripheral wall of the inner member 222 is provided at an opposite side of the gear pump 19, and a face of the flange portion 222*e* at a side of the gear pump 19 is formed to have a tapered face 222*d*.

The annular rubber member 223, which is configured by an O-ring or the like, is fitted to the outer peripheral wall of the inner member 222 and is disposed between the inner member 222 and the outer member 224. The annular rubber member 223 serves to increase a contact pressure on the pressure receiving face of the inner member 222 along with the increase of the discharge pressure during operation of the gear pump 19, and thus seals between the high-pressure discharge side of the gear pump 19 and the low-pressure periphery of each of the shafts 215 and 216 or the suction side of the gear pump 19, by being in contact with the bottom face of the recessed portion 201*a*. The annular rubber member 223 may be molded in a shape corresponding to an appearance of the inner member 22, or may be fitted on the outer peripheral wall of the inner member 222 to meet the appearance of the inner member 222 by the elastic deformation of the circular shape.

The outer member 224 seals between the high-pressure side and the low-pressure side on the end face of the gear pump 19 in the axial direction. The outer member 224 is formed in a nearly triangular shape having a hollow portion corresponding to the appearance of the inner member 222. Further, the outer member 224 uses the end face at a side of the gear pump 19 as a sealing face and seals the sealing face with being contacted on the end face of the rotors 19*d* and 19*e*.

According to this structure, the seal mechanism 221 seals between the high-pressure side and the low-pressure side at the end face of the gear pump 19 by being contacted on the axial direction end face of the gear pump 19, and a seal between the low-pressure side and the high-pressure side even at the bottom face of the recessed portion 201*a* by being contacted on the bottom face of the recessed portion 201*a*.

Incidentally, the seal mechanism 225 also has an inner member 226 and an annular rubber member 227 and an outer member 228, and formed in a nearly triangular shape corresponding to the cylinder 211. Since the seal mechanism 225 is different from the seal mechanism 221 in that the face forming the seal together with the seal mechanism 221 is at the opposite side thereof, the seal mechanism 225 is formed in a symmetrical shape with respect to the seal mechanism 221. However, since the seal mechanism 225 is the same as the seal mechanism 221 in its basic structure, detailed descriptions of the seal mechanism 225 will be omitted.

The gear pump device of the present embodiment is constructed as described above. In the gear pump device, when the gear pumps 19 and 39 perform the suction and discharge operation, the discharge pressure of high pressure is introduced into the discharge chamber, and then the low-pressure section of the suction side and the periphery of each shaft 215, 216 and the high-pressure section of the discharge side are formed. As shown in FIG. 8, the discharge pressure is introduced to the outer side of the annular rubber members 223 and 227 in the seal mechanisms 221 and 225, and thereby the outer side becomes a high-pressure state. Since the inner side thereof is a suction side, the inner side thereof becomes a low-pressure state.

Therefore, the annular rubber members 223 and 227 press the pressure receiving faces of the inner members 222 and 226 in the vertical direction, based on the discharge pressure. Specifically, as shown in FIG. 10, the pressure receiving face of the inner member 222 is pressed in the vertical direction with respect to the face and the propulsive force is generated in the direction that the inner member 22 moves away from the gear pump 19 so that the inner member 222 contacts on the bottom face of the recessed portion 201*a*, thereby eliminating the gap between them. The same manner will be applied to the inner member 226. The pressure-receiving face of the inner member 226 is pushed in the vertical direction with respect to the face and a propulsive force is generated in a direction that the inner member 226 moves away from the gear pump 39, so that the inner member 226 contacts on the end face of the plug 212, thereby eliminating the gap between them.

Further, the annular rubber members 223 and 227 are pressed on the bottom face of the recessed portion 201*a* or the end face of the plug 212 by the discharge pressure of high pressure. Therefore, it is possible to seal the high-pressure side of the outer side and the low-pressure side of the inner side with respect to the annular rubber member 223, by the annular rubber member 223 and the inner member 222. Also, it is possible to seal the low-pressure side of the inner side and the high-pressure side of the outer side with respect to the annular rubber member 227 by the annular rubber member 227 and the inner member 226.

As described above, the inner members 222 and 226 are contacted on the bottom face of the recessed portion 201*a* or the end face of the plug 212, thereby eliminating the gap therebetween and also accurately sealing between the high-pressure side and the low-pressure side. Therefore, it is possible to suppress a pressure leakage in case that a gap is formed therebetween and deterioration in durability when the annular rubber member 223 enters the gap to thereby be deformed abnormally. The pressure receiving face is formed to have a tapered face 222*d*. For that reason, the discharge pressure applied in a direction perpendicular to the tapered face 222*d* can be converted efficiently to a propulsive force that causes the inner members 222 and 226 to move to the opposite side of the gear pumps 19 and 39, during the high-pressure discharge. Therefore, it is possible to eliminate the gap more reliably, thereby enabling to obtain the effect.

Other Embodiment

In each of the above-described embodiments, the pressure receiving faces of the inner members 112 and 222 are made as the tapered faces 112*e* and 222*d* and these are formed by the flange portions 112*f* and 222*e*. Further, the pressure-receiving faces in the inner members 116 and 226 also have the tapered faces, and these are formed by the flange portions. However, it is not needed that the pressure receiving face has a tapered face and also needs not to be formed by the flange portion. That is, the pressure receiving face may be formed by a collar portion that the outer peripheral wall of the inner members 112, 116, 222 and 226 partially protrudes in an outer peripheral direction thereof.

Further, in the first embodiment, the gear pump device as an example is provided with two internal gear pumps in which the first gear is the outer rotors 19*a* and 39*a* and the second gear is the inner rotors 19*b* and 39*b*. In addition, in the second embodiment, the gear pump device as an example is provided with two external gear pumps in which the first gear is the drive gears 19*d* and 39*d* and the second gear is the driven gears 19*e* and 39*e*. Although the gear pumps 19 and 39 are used in both the above-described examples, a gear pump device having only one gear pump may be used. In each of the above-described embodiments, since the gear pump device provided therein with two gear pumps 19 and 39 is illustrated, the case forming the receiving portion (rotor chambers 100*a* and 100*b* or pump chambers 213 and 214) of each of the gear pumps 19 and 39 is configured by the housings 101 and 201 or cylinders 71 and 211 and plugs 72 and 212. In the case where only one gear pump is provided, the case may be formed with only a member configuring the receiving portion of the gear pump.

What is claimed is:

1. A gear pump device, comprising:

a gear pump, which includes a first gear and a second gear configured to engage with the first gear so that a suction and discharge operation of fluid is performed by the first gear and the second gear being rotated based on a rotation of a shaft;

a casing, which configures a receiving portion in which the first gear and the second gear are accommodated; and a seal mechanism, which is provided between an outer shell of the casing and the gear pump, the seal mechanism defining a low-pressure side including a suction side of the gear pump that sucks the fluid and a periphery of the shaft and a high-pressure side including a discharge chamber that discharges the fluid, wherein the seal mechanism includes:

an annular rubber member, which surrounds the low-pressure side and seals between the low-pressure side and the high pressure side;

an outer member, which is arranged at an outer side of the annular rubber member to contact an end face of the first gear and the second gear in the axial direction; and an inner member, which has an outer peripheral wall on which the annular rubber member is mounted, the inner member fitted into an inner side of the outer member and contacting on an inner wall face of the outer shell of the casing at an opposite side of the gear pump, wherein the outer peripheral wall of the inner member is provided with a collar portion that generates a propulsive force towards the inner wall face of the outer shell of the casing by a contact pressure of the annular rubber member based on a discharge pressure of the gear pump, and the collar portion forms a pressure receiving face to increase the propulsive force as the contact pressure of the annular rubber member increases according to an increase of the discharge pressure.

2. The gear pump device according to claim 1, wherein the annular rubber member contacts on the outer member.

3. The gear pump device according to claim 1, wherein the collar portion is a flange portion formed on the outer peripheral wall of the inner member, and the face of the flange portion facing the annular rubber member is a tapered face.

* * * * *